US005477650A

United States Patent [19]

Centa

[11] Patent Number: 5,477,650

[45] Date of Patent: Dec. 26, 1995

[54] EDGING STRIPS FOR FLOOR COVERINGS

[76] Inventor: Antony R. Centa, Howe Green Lane, Little Berkhamsted, Hertfordshire SG13 8LH, United Kingdom

[21] Appl. No.: 325,320

[22] PCT Filed: May 17, 1993

[86] PCT No.: PCT/GB93/01002

§ 371 Date: Oct. 25, 1994

§ 102(e) Date: Oct. 25, 1994

[87] PCT Pub. No.: WO93/24720

PCT Pub. Date: Dec. 9, 1993

[30] Foreign Application Priority Data

May 30, 1992 [GB] United Kingdom ..... 9211498

[51] Int. Cl.[6] ..... E04B 5/48; B32B 3/10

[52] U.S. Cl. ..... 52/288.1; 52/718.04; 52/730.1; 428/33; 428/45

[58] Field of Search ..... 52/177, 287.1, 52/288.1, 395, 402, 718.01, 718.04, 730.1, 480, 730.3, 731.1, 220.5; 428/33, 45, 95, 192, 582

[56] References Cited

U.S. PATENT DOCUMENTS

| | | | |
|---|---|---|---|
| 2,498,991 | 2/1950 | Gibson . | |
| 2,996,751 | 8/1961 | Roby et al. | 428/33 X |
| 3,543,326 | 12/1970 | Rohrberg et al. . | |
| 3,549,471 | 12/1970 | Denton | 52/287.1 X |
| 3,593,472 | 7/1971 | Barger et al. . | |
| 3,759,000 | 9/1973 | Balzer et al. . | |
| 4,295,315 | 10/1981 | Lynn-Jones et al. | 52/402 X |
| 4,361,614 | 11/1982 | Moffitt, Jr. | 428/192 X |
| 4,905,431 | 3/1990 | Davis | 52/177 X |
| 5,191,743 | 3/1993 | Gailey | 52/288.1 X |
| 5,192,599 | 3/1993 | Sakamoto | 428/192 X |
| 5,339,586 | 8/1994 | Centa . | |

FOREIGN PATENT DOCUMENTS

| | | |
|---|---|---|
| 2074142 | 10/1971 | France . |
| 2250192 | 6/1992 | United Kingdom . |

*Primary Examiner*—Lanna Mai
*Attorney, Agent, or Firm*—Davis, Bujold & Streck

[57] ABSTRACT

An edging strip of relatively shallow construction is provided which is characterized by an interlocking mechanism comprising a housing strip (2) which is "U" shaped, one sidewall (17) of which is higher than the other sidewall (18) by an amount substantially equal to or greater than the thickness of the floorcovering, and an insert strip (3) which is "L" shaped, the horizontal limb (19) being adapted to fit within the housing strip groove (20) with its upper surface level with or higher than the housing sidewall (18) with its vertical limb (22) adjacent the housing sidewall (17) and of equal height. Co-operating projections (24) and mating recesses (25) are provided in the insert and housing strips which lie in a horizontal plane. Preferably, the housing sidewall (17) is inclined so as to flex and thereby facilitate fixing the insert strip by pressing down along its length to snap fit into the housing strip (2).

8 Claims, 1 Drawing Sheet

EDGING STRIPS FOR FLOOR COVERINGS

This invention relates to edging strips for floorcoverings whereby said coverings can be fixedly located along their edges to an underlying floor surface and is a development of the invention described and claimed in co-pending patent application No. 9124660.3 Ser. No. 2250192.

Floor edging strips can be used for fixing floorcovering around its edges closely adjacent the walls of a room, or they can be used as dividers between two floor areas having different coverings, e.g. between a tiled floor and a carpet or vinyl flooring.

A particular disadvantage of known edging strips is that they tend to protect above the surface of the floorcoverings and, even if they are rounded-off, vehicles passing across the strips tend to be bumped. In circumstances where the vehicles are intended to carry fragile articles, or hospital patients, this is clearly undesirable. Furthermore, repeated Dumping causes the floorcovering to be damaged or broken down.

In said co-pending Patent Application there is described a method of securing an edge of a floorcovering fitted to an underlying floor surface which is characterised by providing an elongate edging strip comprising a housing strip and an insert strip which are interfitted together via co-operating locking means formed on said strips, selecting the material of said insert strip to be of a plastics which will readily bond with the underside of the floorcovering, fixing said edging strip along said floor surface to define a line along which said edge of said floorcovering is to extend so that said housing and insert strips present respective upstanding edges which extend parallel and adjacent each other along said line flush with the surface of the floorcovering when fitted and the insert further presenting a support surface for said edge of the floorcovering, cutting the floorcovering to present an edge which overlies the support surface of the insert strip and abuts said upstanding edge of the insert strip, and bonding the underside of said floorcovering along said edge to said surface and upstanding edge of the insert strip. Said Application also describes preferred embodiments of edging strips adapted to the method. In these preferred embodiments, the interlocking means generally comprises a locking projection extending along one edge of the insert strip for engaging in a co-operating end recess in the housing strip and at least one tongue extending along the other edge of the insert strip which projects downwardly from said strip to engage in a further co-operating recess in the bottom of the housing strip.

Whilst such embodiments have prooved successful in use, the depth of the housing strip needs to be significant to enable the further recess to be accommodated in the bottom of the housing strip. Because of this the floor area to be covered needs to have channels dug out to accommodate the housing strips.

An object of the present invention is to provide an edging strip in which the housing strip can be of shallower depth.

According to the present invention an edging strip for securing floorcovering along an edge thereof to an underlying surface and comprising a pair of elongate housing and insert strips which are adapted to interfit with each other, the housing strip having an upstanding edge which extends to be flush with the surface of the floorcovering when fitted, and the insert strip being of a plastics material to which the underside of the floorcovering can be readily bonded, said insert strip presenting a surface for supporting the underside of the floorcovering along an edge thereof and an upstanding edge which extends to be flush with the surface of the floorcovering when fitted and against which the floorcovering edge abuts, and co-operating interlocking means provided on respective housing and insert strips whereby the insert strip can be fixedly located on the housing strip, is characterised in that said co-operating interlocking means comprise the housing strip being of generally U-shaped cross section, one side wall of which is higher than the other side wall by an amount substantially equal to or greater than the thickness of the floorcovering to be fitted, in that the insert strip is of generally "L" shape, the horizontal limb of which is adapted to fit within the groove defined in said housing adapted to fit within the groove defined in said housing strip with its vertical limb adjacent said one side wall and of a height substantially equal to the height of said one wall, the horizontal limb providing an upper surface, substantially level with or above the height of said other wall of the housing strip, in that said one wall of the housing strip is shaped to provide a mating recess for at least one projection from the vertical limb of said insert strip, and in that the other wall of said housing strip provides a further mating recess for a locking projection in the free edge of the horizontal limb of said insert strip.

BRIEF DESCRIPTION OF THE DRAWINGS

The invention will now be described, by way of example, with reference to the accompanying drawings in which:

FIG. 1A–D of the accompanying drawings are sectional views showing one embodiment of edging strip described in said co-pending patent Application. Thus, referring to FIG. 1 A to C, the edging strip comprises interfitting, elongate housing and insert strips 2,3 respectively. The insert strip 3 is preferably formed from plastics material, e.g. PVC or ABS, and the housing strip 2 is preferably of metal, e.g. Aluminium Alloy or Brass. The housing strip 2 is intended to be located within a channel in the floor surface and presents an upper edge portion 4 intended to lie flush with the upper surface of the covering 5 of the floor (see FIG. 1 D). The upper edge portion 4 defines a recess 6 in its inwardly facing side wall and a shaped further recess 7 is defined in the upper surface 8 from which the portion 4 projects, which surface provides a support for the underside of the insert strip 3. The recess 7 has a sloping engagement face 9 having a locking projection 10 extending longitudinally therealong.

Figure 1A:
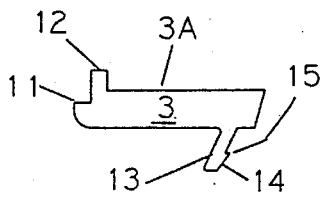
FIGS. 1A–1D are sectional views showing an embodiment of an edge stripping.

The insert strip 3 is basically of shallow, rectangular shape and one edge is provided with a locking projection, or nose 11 and an upper edge portion 12 intended, when fitted, to lie alongside the edge portion 4 of the housing strip, flush with the covering surface 5. Towards the other edge of the insert strip, a resilient tongue 13 projects from the undersurface and is provided with a sloping engagement face 14 and locking projection 15 which are intended to engage and lock against the corresponding engagement face 9 and locking projection 10 of the housing strip. The insert strip provides a recessed upper surface 3A which is intended to be secured to the undersurface of a flexible floor covering to be used therewith, along an edge thereof. It will be appreciated that the depth of this recess will be equal to the thickness of the particular floor covering so that the upper surface of the latter will lie flush with the upper edge portions 4 and 12. The type of plastics for the insert strip will be chosen in dependence upon the particular floor covering material to be used, and the manner in which it is to be attached to said floorcovering, attachment being effected by suitable means e.g. an appropriate adhesive, heat welding, or a combination of both, or gripping devices.

Figure 1C:
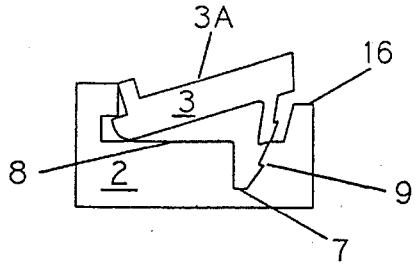
Figure 1B:
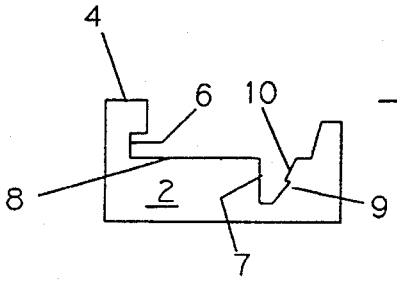
Figure 1D:
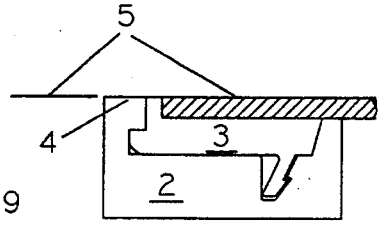

To interfit the strips, the insert strip 3 is angled downwardly toward its said one edge as shown in FIG. 1C to engage the locking nose 11 in its co-operating recess 6 in the housing strip 2 and the other edge of the insert strip is then pressed downwardly whereby the resilient tongue 13 enters its co-operating recess 7 and flexes into the position as shown in FIG. 1D in which the co-operating projections 15 and 10 are locked together. It will be noted from FIG. 1D that the housing strip 2 has a further upper edge portion 16 spaced from portion 4 and that these two portions, together with the upper surface 8, provide a shallow recess in which the insert strip snugly sits when fitted. The floorcovering may be secured along its edge to its respective insert strip 3 either before or after its location in the housing strip 2. The adhesive or welding attachment of the floorcovering and insert strip should be waterproof, and to ensure total protection against moisture penetration under the floorcovering, a mastic can be used between the insert and housing strips during fitting.

In order that the development provided by the present invention can be readily understood, one embodiment will now be described with reference to FIG. 2 of the accompanying drawings, which is a cross-section of the housing and insert strips shown interfitted.

Figure 2:
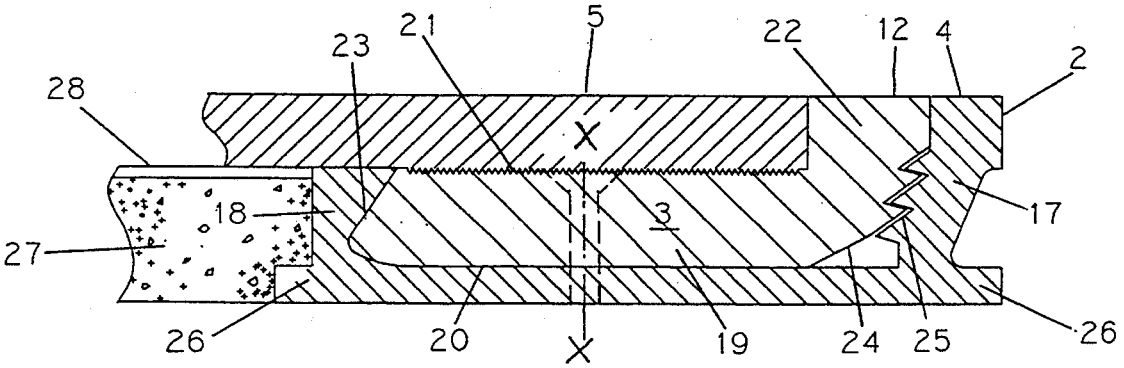
FIG. 2 is a cross-sectional view of the housing and insert strips shown interfitted.

Referring to FIG. 2 the housing strip 2 is preferably formed from metal, such as Aluminium or Brass, and is of generally U-shaped cross-section. One side wall 17 is higher than the other side wall 18 by an amount substantially equal to the thickness of the floorcovering 5 to be fitted to provide an edge 4 flush with the intended floor surface. The insert strip 3 is preferably of a resilient plastic material, such as ABS or PVC, and is of generally L-shaped cross-section, the horizontal limb 19 of which is adapted to be a snap fit within the groove 20 defined in the housing strip 2 and present an upper surface 21 level with the upper edge of the wall 18. The vertical limb 22 of the insert strip is intended to lie alongside the wall 17 of the housing strip with its upper edge 12 flush with the upper edge 4 of said wall 17.

To facilitate snap fitting, the free edge 23 of the insert strip 3 is inclined and adapted to fit in a mating recess formed in the wall 18 of the housing strip, whilst its other edge is formed with a series of projecting tongues 24 which are sufficiently resilient to snap into a series of mating recesses 25 formed in the housing strip wall 17 when the insert is pressed into its located position. However, as shown, the wall 17 can be reduced to an appropriate thickness and inclined to enable it to flex when the insert strip is pressed to facilitate fitting. Alternatively, if the insert strip is made of a less resilient material, snap fitting can be achieved by pressing down on the wall 17 to flex it more fully.

The outer edges of the housing strip 2 are provided with fingers 26 as shown to act as keys for fixidly locating the strip in position within channels appropriately dug out from the underlying floor surface.

It will be appreciated that the floor covering can be fixed to the insert strip 3 either before or after the latter is fitted into the housing strip 2. Fixing is achieved by use of a suitable adhesive, heat welding, etc. onto the surface 21, which can be serrated as shown, to improve the quality of the joint.

It will be further appreciated that the fixing tongues 24 and mating recesses constitute interlocking means. By comparison with the interlocking means previously proposed in said co-pending Application, e.g. as described above with reference to FIG. 1 of the present Application, it will be noted that because the tongues 24 and recesses 25 are in the plane of the insert strip 3, the thickness of the bottom wall of the housing strip 2 is much reduced and would therefore require a smaller locating channel in the floor surface. However, preferably the depth of the housing strip 2 is made sufficiently shallow so the edging can be fixed directly onto the underlying floor surface, thereby avoiding the need for a channel. In this case, the level of the area of the floor surface to be covered by the floorcovering is made up by an underlay of appropriate thickness, or (as shown) by mortar covered 27 by a latex screed 28, according to the particular application.

Also, where the edging is fixed directly to the floor surface, this would be effected with the housing and insert strips in their fitted-together condition, via appropriate fixing bolts or fastenings connected therethrough, e.g. as indicated by the dotted line X.—.X. After fixing of the edging, the floorcovering 5 would then be attached permanently to the surface 21 of the insert strip.

I claim:

1. An edging strip for securing floorcovering along an edge thereof to an underlying surface and comprising a pair of elongate housing and insert strips (2,3) which are adapted to interfit with each other, the housing strip (2) having an upstanding edge (4) which extends to be flush with the surface of the floorcovering (5) when fitted, and the insert strip (3) being of a plastics material to which the underside of the floorcovering can be readily bonded, said insert strip presenting a surface (21) for supporting the underside of the floorcovering along an edge thereof and an upstanding edge (12) which extends to be flush with the surface of the floorcovering when fitted and against which the floorcovering edge abuts, and co-operating interlocking means (24, 25) provided on respective housing and insert strips whereby the insert strip can be fixedly located on the housing strip, characterised in that said co-operating interlocking means comprise the housing strip (2) being of generally U-shaped cross section, one side wall (17) of which is higher than the other side wall (18) by an amount substantially equal to or greater than the thickness of the floorcovering to be fitted, in that the insert strip (3) is of generally "L" shape, the horizontal limb (19) of which is adapted to fit within the groove (20) defined in said housing strip with its vertical limb (22) adjacent said one side wall (17) and of a height substantially equal to the height of said one wall, the horizontal limb providing an upper surface, substantially level with or above the height of said other wall (18) of the housing strip, in that said one wall (17) of the housing strip is shaped to provide a mating recess (25) for at least one projection (24) from the vertical limb of said insert strip, and in that the other wall (18) of said housing strip provides a further mating recess for a locking projection in the free edge (23) of the horizontal limb of said insert strip.

2. An edging strip according to claim 1, characterised in that said projection (24) is resilient to enable the insert strip to be fitted by pressing down along its length, and in that one wall (17) of the housing strip (2) is of appropriate thickness and inclined to enable it to flex during fixing of the insert strip (3) to facilitate snap fitting of said resilient projection (24) into its mating recess (25).

3. An edging strip according to claim 2, characterised in that a series of projections (24) and mating recesses (25) are provided.

4. A floor surface covered by a floorcovering, characterised by at least one edge of said floorcovering (5) being secured by an edging strip according to claim 3.

5. A floor surface covered by a floorcovering, characterised by at least one edge of said floorcovering (5) being secured by an edging strip according to claim 2.

6. An edging strip according to claim 1, characterised in that a series of projections (24) and mating recesses (25) are provided.

7. A floor surface covered by a floorcovering, characterised by at least one edge of said floorcovering (5) being secured by an edging strip according to claim 6.

8. A floor surface covered by a floorcovering, characterised by at least one edge of said floorcovering (5) being secured by an edging strip according to claim 1.

* * * * *